US007446717B2

(12) United States Patent
Hung et al.

(10) Patent No.: US 7,446,717 B2
(45) Date of Patent: Nov. 4, 2008

(54) MULTI-BAND ANTENNA

(75) Inventors: Chen-Ta Hung, Tu-Cheng (TW); Po-Kang Ku, Tu-Cheng (TW); Yao-Shien Huang, Tu-Cheng (TW)

(73) Assignee: Hon Hai Precision Inc. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/638,597

(22) Filed: Dec. 12, 2006

(65) Prior Publication Data

US 2007/0132646 A1 Jun. 14, 2007

(51) Int. Cl.
*H01Q 1/24* (2006.01)

(52) U.S. Cl. ..... 343/702; 343/700 MS; 343/846

(58) Field of Classification Search ..... 343/702, 343/700 MS, 846
See application file for complete search history.

(56) References Cited

U.S. PATENT DOCUMENTS

| | | | | |
|---|---|---|---|---|
| 6,864,845 | B2 * | 3/2005 | Kuo et al. | 343/702 |
| 7,034,754 | B2 * | 4/2006 | Hung et al. | 343/700 MS |
| 7,289,071 | B2 * | 10/2007 | Hung et al. | 343/702 |
| 2005/0259024 | A1 * | 11/2005 | Hung et al. | 343/770 |
| 2006/0001590 | A1 * | 1/2006 | Hung et al. | 343/846 |
| 2007/0013588 | A1 * | 1/2007 | Chen et al. | 343/702 |
| 2007/0018896 | A1 * | 1/2007 | Chen et al. | 343/702 |

* cited by examiner

*Primary Examiner*—Hoang V Nguyen
(74) *Attorney, Agent, or Firm*—Wei Te Chung

(57) ABSTRACT

A multi-band antenna includes a first antenna operating at wireless wide area network and having a first radiating arm, a second antenna operating at wireless local area network and a grounding portion employed by the first antenna and the second antenna. Wherein the first radiating arm of the first antenna further includes a metallic sheet, an insulative member affixed to the metallic sheet and a metal foil affixed to the insulative member.

20 Claims, 6 Drawing Sheets

MULTI-BAND ANTENNA

BACKGROUND OF THE INVENTION

1. Field of the Invention

The present invention relates generally to an antenna, and more particularly to a multi-band antenna used for electronic devices, such as notebook.

2. Description of Prior Art

With the high-speed development of the mobile communication, people more and more expect to use a computer or other portable terminals to optionally connect to Internet. GPRS (General Packer Radio Service) and WLAN (Wireless Local Area Network) allow users to access data wirelessly over both cellular networks and 802.11b WLAN system. When operating in GPRS, the data transmitting speed is up to 30 Kbps~50 Kbps, while when connected to a WLAN access point, the data transmitting speed is up to 11 Mbps. People can select different PC cards and cooperate with the portable terminals such as the notebook computer or the like. to optionally connect to Internet. Since WLAN has a higher transmitting speed, WLAN is usually used to provide public WLAN high-speed data services in some hot areas (for example, hotel, airport, coffee bar, commerce heartland, conference heartland and etc.). When leaving from these hot areas, network connection is automatically switched to GPRS.

As it is known to all, an antenna plays an important role in wireless communication. As a result, the PC card may choose individual antennas to respectively operate at WWAN (Wireless Wide Area Network), namely GPRS, and WLAN. It arises a hot problem to integrate two individual antennas in a limited space to go along with the miniaturization of portal devices. Please refer to FIG. 1, a multi-band antenna 10' comprises a first type of antenna which is used in WWAN and has first and second antennas 1', 2' and a second type of antenna which is used in WLAN and has third and fourth antennas 3', 4'. The multi-band antenna 10' is integrally made from a metal sheet and integrates the first type of antenna for WWAN and the second type antenna for WLAN together. However, with the two types of antennas integration, the interference therebetween will become greater, and owing to this structure, the antenna 1' can not achieve enough bandwidth. Hence, it is necessary to be concerned by researchers skilled in the art how to incorporate two antennas respectively operating at WWAN and WLAN into a single antenna while keeping enough bandwidth and low interference.

SUMMARY OF THE INVENTION

An object of the present invention is to provide a multi-band antenna which integrate the antenna for WWAN and the antenna for WLAN together with merits of mini-structure, easy manufacturing, and low cost.

Another object of the present invention is to provide an antenna with reduced installation space and excellent performance.

To achieve the aforementioned object, a multi-band antenna comprises a first antenna operating at wireless wide area network and having a first radiating arm, a second antenna operating at wireless local area network and a grounding portion employed by the first antenna and the second antenna. Wherein the first radiating arm of the first antenna further comprises a metallic sheet, an insulative member affixed to the metallic sheet and a metal foil affixed to the insulative member.

Additional novel features and advantages of the present invention will become apparent by reference to the following detailed description when taken in conjunction with the accompanying drawings.

DETAILED DESCRIPTION OF THE INVENTION

Reference will now be made in detail to the preferred embodiment of the present invention.

Figure 1:
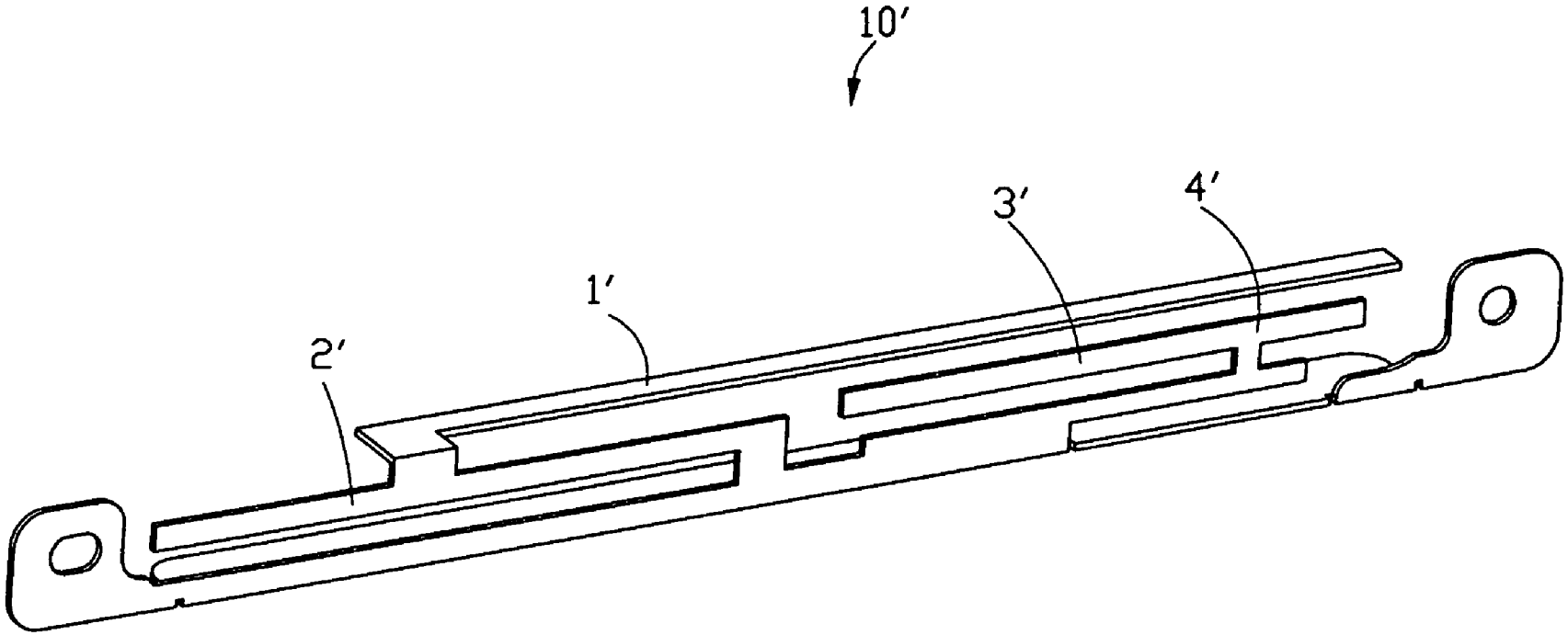
FIG. 1 is a perspective view of a conventional multi-band antenna.
Figure 2:
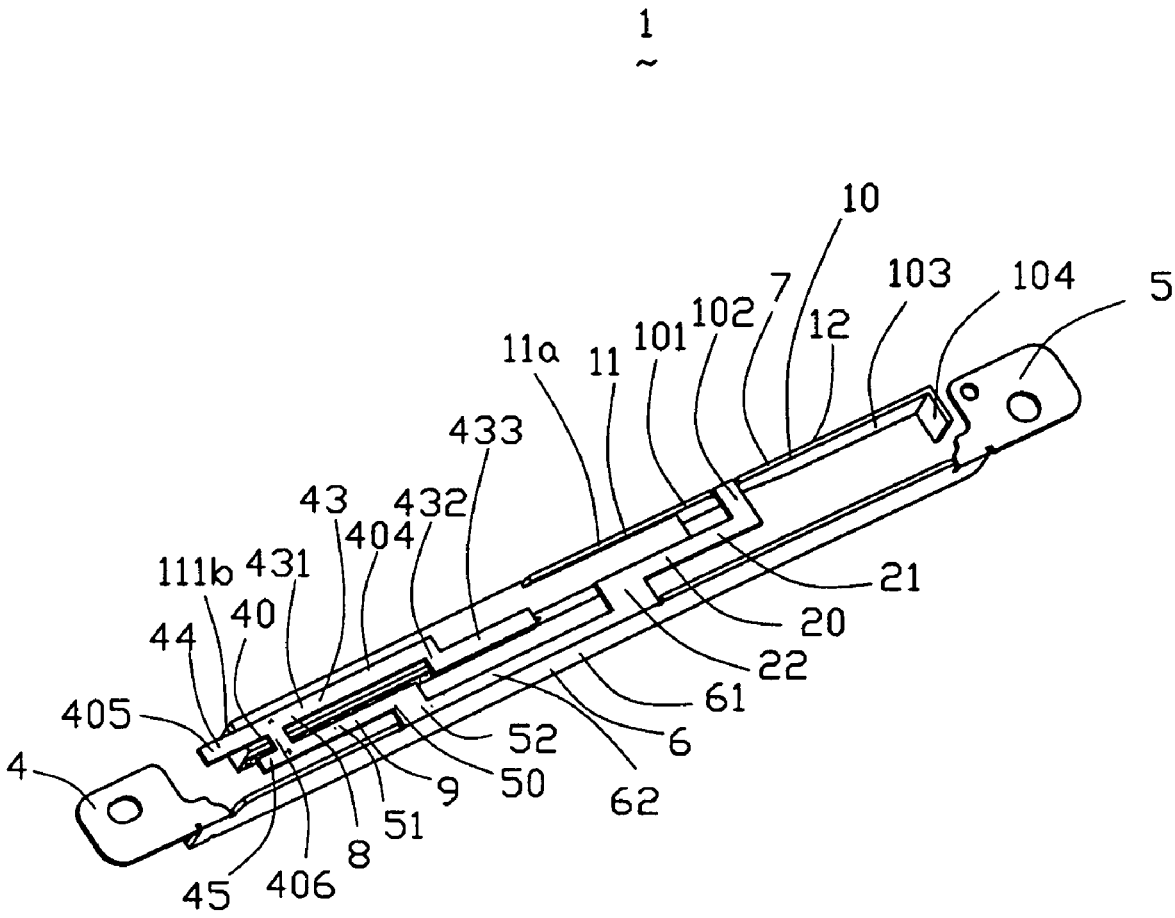
FIG. 2 is a perspective view of a multi-band antenna in accordance with a preferred embodiment of the present invention.
Figure 3:
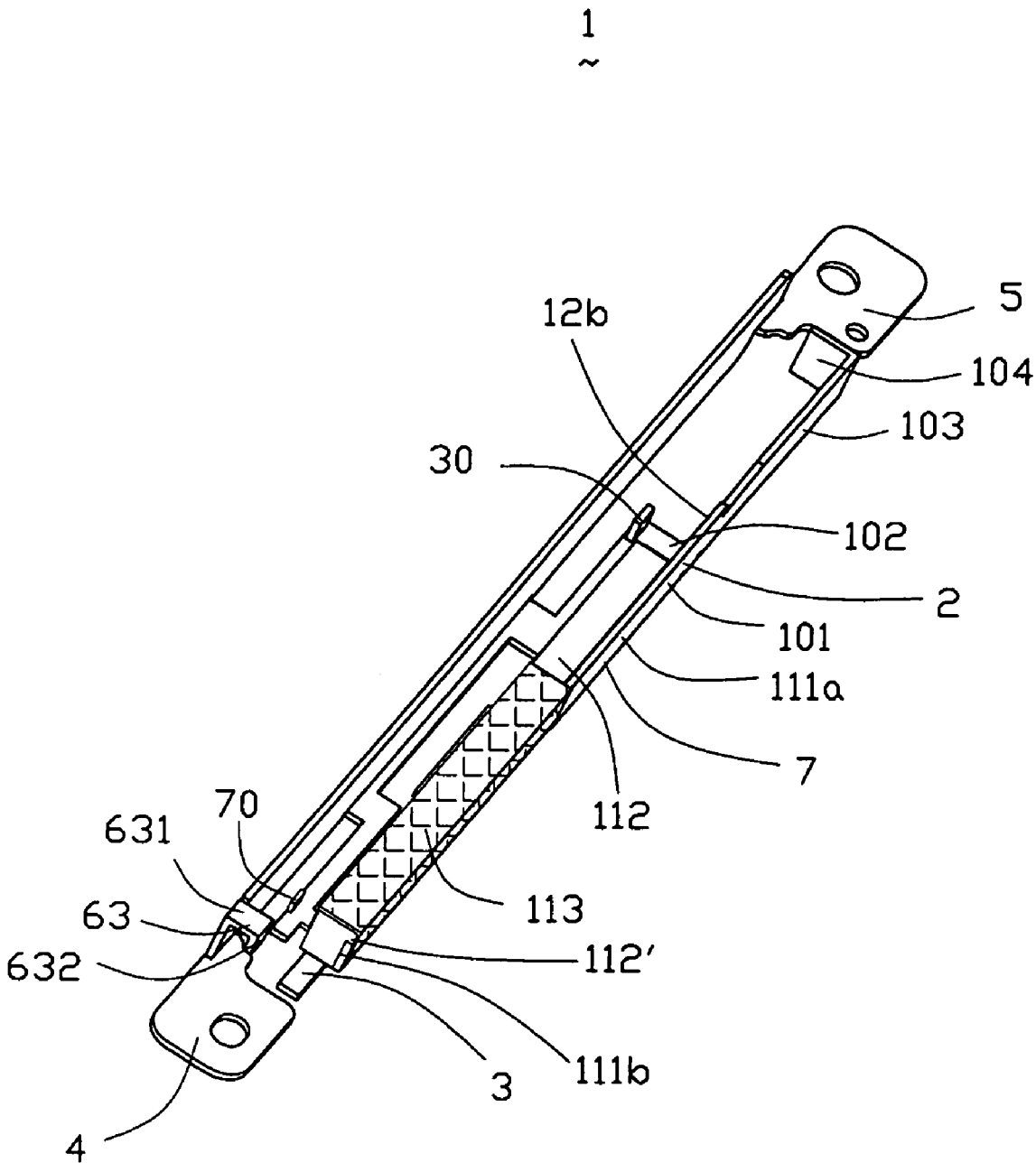
FIG. 3 is a view similar to FIG. 2, but taken from a different aspect.
Figure 4:
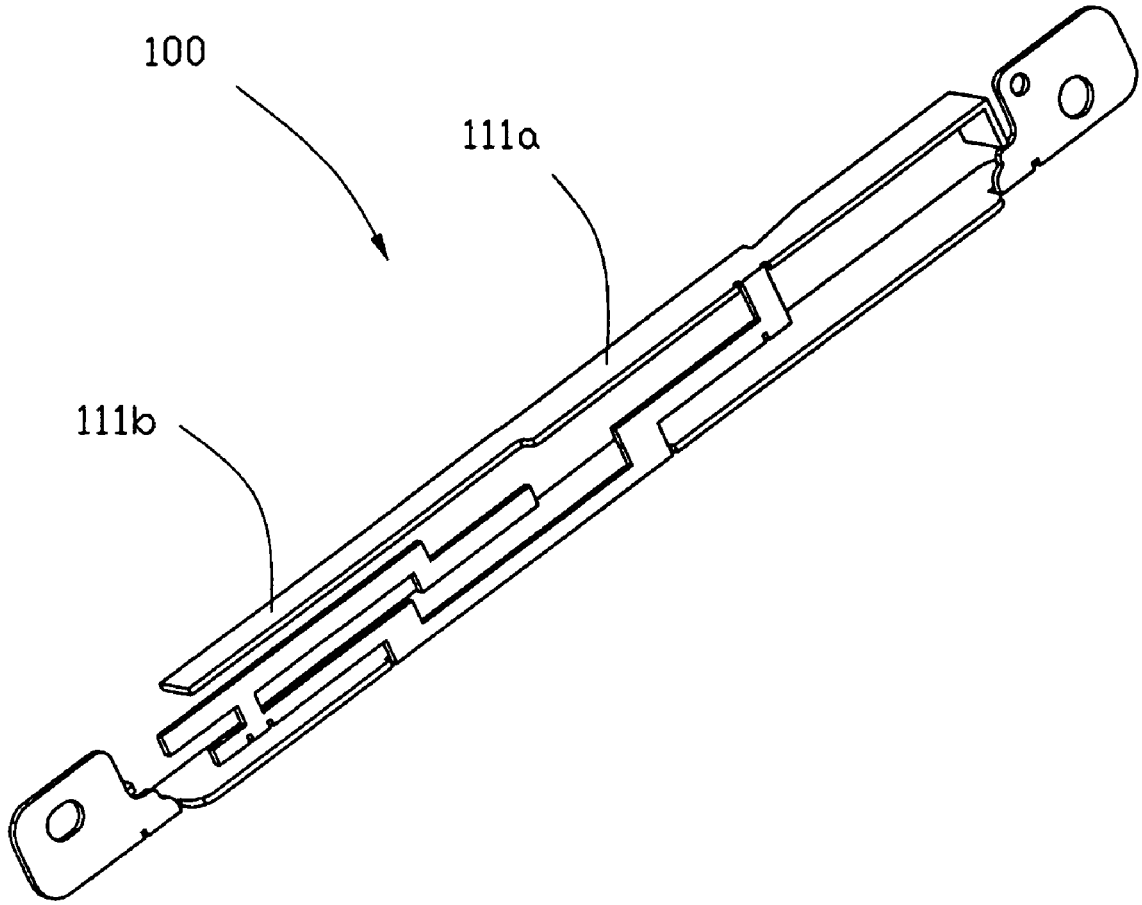
FIG. 4 is a perspective view of an antenna body of the present invention.
Figure 5:
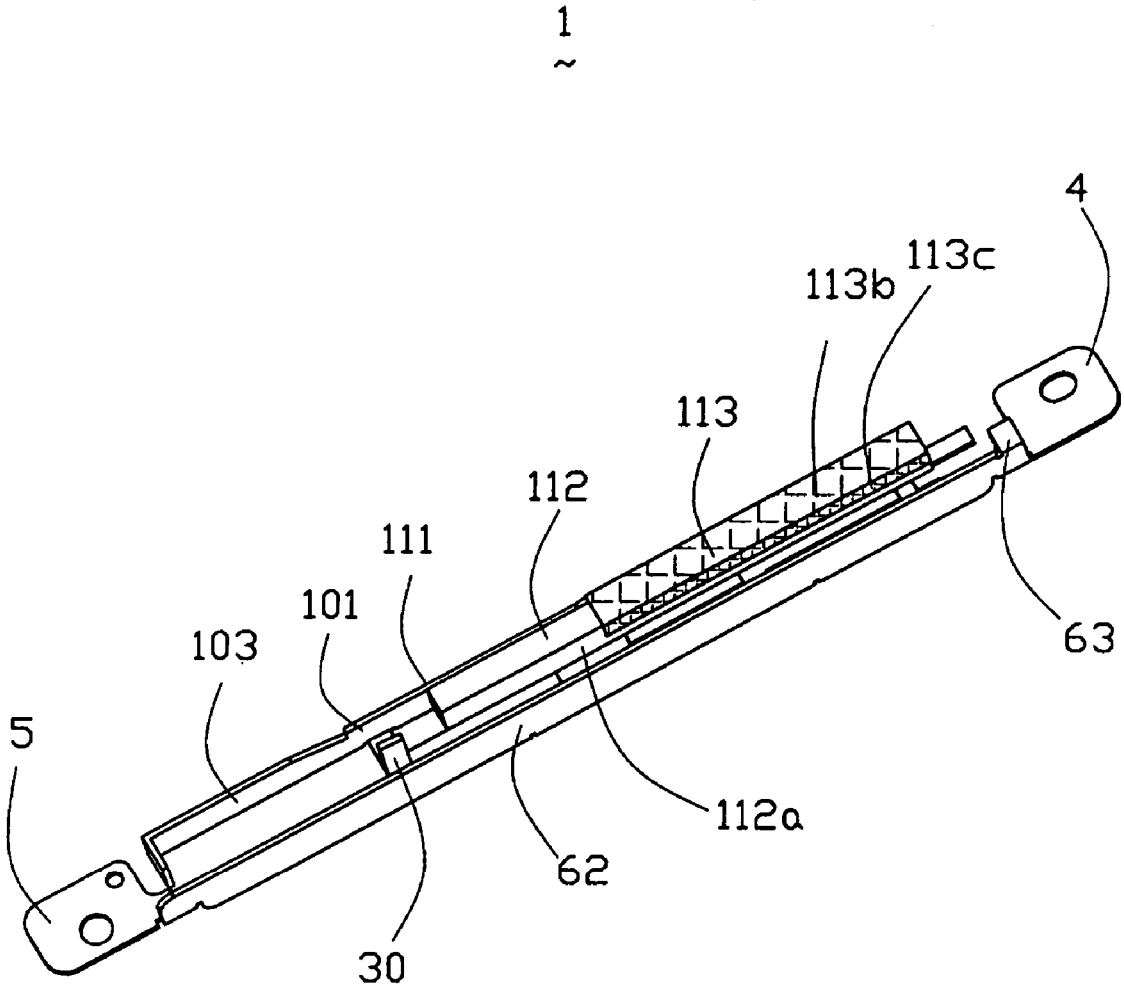
FIG. 5 is a view similar to FIG. 2, but taken from another different aspect.
Figure 6:
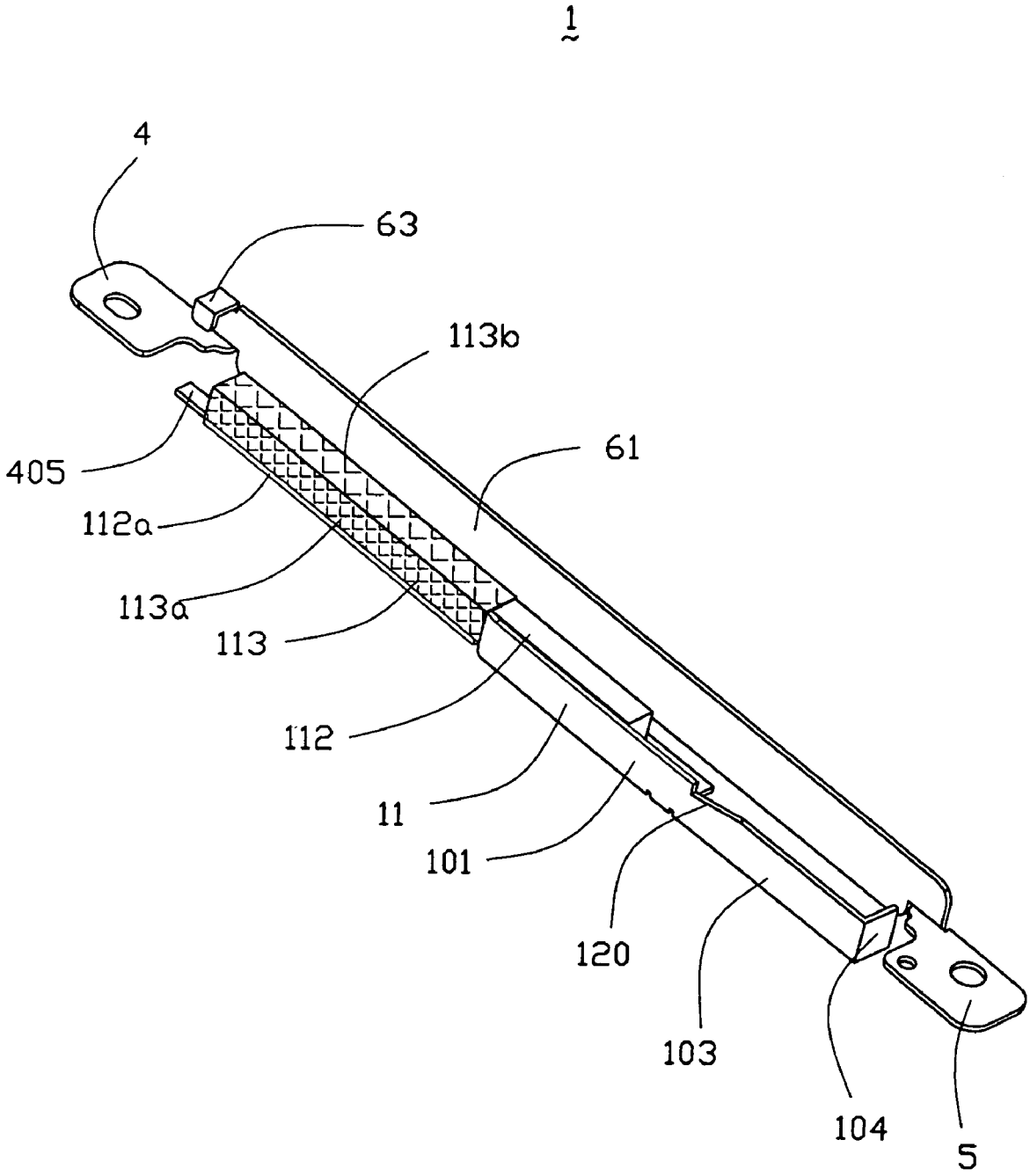
FIG. 6 is a view similar to FIG. 2, but taken from a further different aspect.

Referring to FIGS. 2-6, a multi-band antenna 1 in accordance with a preferred embodiment of the present invention consists of an antenna body 100, an insulative member 112 affixed to the antenna body 100 and a metal foil 113. The multi-band antenna 1 comprises a first antenna 2 used in WWAN, a second antenna 3 used in WLAN and a grounding portion 6 employed in each antenna 2, 3. The grounding portion 6 comprises a first grounding portion 61 and a bending portion 62 perpendicularly extending from the first grounding portion 61. The multi-band antenna 1 is integrally made from a metal sheet and integrates the first type of antenna for WWAN and the second type of antenna for WLAN together.

The first antenna 2 comprises a first radiating member 10, a first connecting portion 20 and the grounding portion 6. The first radiating member 10 comprises a first radiating portion 11 and a second radiating portion 12 arranged in a line with the first radiating portion 11. The first radiating portion 11 comprises a first radiating arm 101 and a second radiating arm 102 perpendicular to the first radiating arm 101. The second radiating portion 12 comprises a second radiating arm 102, a third radiating arm 103 perpendicular to the second radiating arm 102 and a fourth radiating arm 104 extending downwardly and perpendicularly from the third radiating arm 103. The first radiating arm 101 comprises a metal sheet 111, an insulative member 112 affixed to the metal sheet 111 and a metal foil 113 affixed to the metal sheet 111 and the insulative member 112. The metal foil 113 can be many kinds of metallic materials, and in preferred embodiment, the metal foil is AL foil. The metal sheet 111 is L-shaped and comprises a wider portion 111*a* and a narrower portion 111*b* extending vertically from the wider portion 111*a*. One side surface of the insulative member 112 affixes to the surface of the metal sheet 111 facing to the first grounding portion 61, another side surface of the insulative member 112 affixes to the second antenna 3 and one surface of the insulative member 112 facing to the first grounding portion 61 is designated as a lower wall. The insulative member 112 is substantially cuboid shaped to adapt to the L-shaped metal sheet 111, and has a protruding rib 112' engaging with the narrower portion 111*b* to make sure the distal end of the protruding rib 112' and the distal end of the metal sheet 111 are coplanar.

The metal foil 113 is featured with inverted-U shape and comprises a top wall 113*a*, a bottom wall 113*c* and a side wall 113*b* connecting with the top wall 113*a* and the bottom wall 113*c*. The side wall 113*b*, the top wall 113*a* and the bottom wall 113*c* all affix to the insulative member 112, and the top wall 113*a* further electrically connects to the metal sheet 111. The top wall 113*a* is narrower than the wall of the insulative member 112 affixed by the top wall 113*a* in order to avoid electrically contacting with the second antenna 3. The first radiating arm 101 has a lateral wall 11*a* connecting with the second radiating arm 102. The third radiating arm 103 and the first radiating arm 101 of the second radiating portion 12 together form a first metallic arm 7. The fourth radiating arm 104 extends perpendicularly from the distal end of the third radiating arm 103 along the vertical direction. The third radiating arm 103 defines a lateral wall 12*b* opposite to the second radiating arm 102 and defines a triangular notch 120 to improve the impedance matching. The first radiating portion 11 of the first antenna 2 is used to receive/transmit low frequency, whereas the second radiating portion 12 of the first antenna 2 is used to receive/transmit high frequency.

The first connecting portion 20 comprises a first connecting arm 21 extending perpendicularly from the second radiating arm 102 and a second connecting arm 22 extending perpendicularly from the first connecting arm 21. The second radiating arm 102 and the first connecting portion 20 are coplanar in the same plane which is perpendicular to the first metallic arm 7 and the fourth radiating arm 104. The junction of the first connecting arm 21 and the second radiating arm 102 has a heave 30 which is perpendicular to the first connecting portion 20 and parallel to the first metallic arm 7. The heave 30 is used to connect with a feeding line (not shown). In alternative embodiment, the heave 30 can be located in alternative places to change the radiating frequency of the radiating portion.

The second antenna 3 comprises a second radiating member 40, a second connecting portion 50 and the grounding portion 6. The second connecting portion 50 comprises a third connecting arm 51 and a fourth connecting arm 52 perpendicular to the third connecting arm 51. The second radiating member 40 comprises a third radiating portion 43, a fourth radiating portion 44 and a fifth radiating portion 45. The third radiating portion 43 comprises a Z-shaped metallic arm 404 and a bending arm 406 extending perpendicularly from the metallic arm 404. The fourth radiating portion 44 comprises a bending arm 406 and a fifth radiating arm 405. The Z-shaped metallic arm 404 of the third radiating portion 43 comprises a first arm 431 connecting with the fifth radiating arm 405, a second arm 432 extending perpendicularly and downwardly from the first arm 431 and a third arm 433 extending perpendicularly to the second arm 432 and parallel to the first arm 431. The fifth radiating arm 405 and the first arm 431 together and electrically form a second elongated metallic arm 8. The bending arm 406 extends from the junction of the fifth radiating arm 405 and the first arm 431 and perpendicular to the second elongated metallic arm 8. The fifth radiating portion 45 is perpendicular to the bending arm 406 and extends along the direction parallel to the fifth radiating arm 405. The fifth radiating portion 45 and the third connecting arm 51 together and electrically form a third elongated metallic arm 9. The second elongated metallic arm 8 is parallel to and spaced from the third elongated metallic arm 9 a predetermined distance. The junction of the fifth radiating portion 45, the bending arm 406 and the third connecting arm 51 forms a projection 70 projecting therefrom and perpendicular to the second connecting portion 50 and parallel to the first elongated metallic arm 7 to be used to connect a feeding line (not shown) of the second antenna 3. In alternative embodiment, the location of the projection 70 can be changed for the purpose of shifting the radiating or receiving frequency. The third radiating portion 43 is used to radiate/receive the low-frequency, whereas the fourth radiating portion 44 is used to radiate/receive the high-frequency, and the fifth radiating portion 45 is used to amplify the band-volume of the fourth radiating portion 44.

The grounding portion 6 is a metal plate, and comprises the first grounding portion 61, a first mounting portion 4 and a second mounting portion 5 respectively located at two distal ends of the first grounding portion 61. The first mounting portion 4 and the second mounting portion 5 together form a mounting plane. The first grounding portion 61 defines an L-shaped strip 63 at one side of the distal end thereof which is opposite to the first mounting portion 4. The strip 63 comprises a main portion 631 extending perpendicularly and from the first grounding portion 61 and a parallel arm 632 parallel to the first grounding portion 61. The two distal ends of the bending portion 62 respectively connect with the second connecting arm 22 of the first antenna 2 and the fourth connecting arm 52 of the second antenna 3.

The second antenna 3, the second radiating arm 102 and the first connecting portion 20 of the first antenna 2 and the bending portion 62 of the grounding portion 6 are in the same plane. The first elongated metallic arm 7 is parallel to the first grounding portion 61.

In preferred embodiment, the insulative member 112 affixes to the metal sheet 111 of the first antenna 2. Owing to the different dielectric constant between the metal sheet 111 and the insulative member 112, the first radiating portion 11 of the first antenna 2 is capable of achieving the same frequency with shorter radiating length than that of first radiating portion 11 without the insulative member 112, nevertheless accompanying with the defect of reducing the radiating energy. Then, the inverted-U shaped metal foil 113 affixed to the insulative member 112 is capable of enlarging the area of the first antenna 2, namely enlarging the band-volume of the first antenna 2, thus, the radiating energy of the first antenna 2 will be compensated. Therefore, the first antenna 2 is capable of being operated at the predetermined frequency, the enough band-volume and the radiating energy with small compact size. The third radiating portion 43 of the second antenna 3 is configured with Z-shape to decrease its relative length. Thus, the lengths of the first radiating portion 11 of the first antenna 2 and the third radiating portion 43 of the third antenna 3 are all decreased. In alternative embodiment, other metal foil, such as Cu foil, can replace the metal foil 113.

While the foregoing description includes details which will enable those skilled in the art to practice the invention, it should be recognized that the description is illustrative in nature and that many modifications and variations thereof will be apparent to those skilled in the art having the benefit of these teachings. It is accordingly intended that the invention herein be defined solely by the claims appended hereto and that the claims be interpreted as broadly as permitted by the prior art.

What is claimed is:

1. A multi-band antenna comprising:

a first antenna operating at wireless wide area network, and comprising a first radiating arm;

a second antenna operating at wireless local area network;

a grounding portion employed by the first antenna and the second antenna; and wherein the first radiating arm of the first antenna comprises a metallic sheet, an insulative member affixed to the metallic sheet and a metal foil affixed to the insulative member.

2. The multi-band antenna as claimed in claim 1, the structure of the first antenna is different from that of the second antenna, and the first antenna and the second antenna are substantially arranged in a line.

3. The multi-band antenna as claimed in claim 1 wherein said first antenna comprises a first radiating element having a first radiating portion and a second radiating portion, said grounding portion and a first connecting portion connecting with the first radiating element and said grounding portion.

4. The multi-band antenna as claimed in claim 3, wherein said first radiating element comprises a first radiating portion and a second radiating portion defining a second radiating arm, a third radiating arm and a fourth radiating arm extending perpendicularly and downwardly from the distal end of the third radiating arm.

5. The multi-band antenna as claimed in claim 1, wherein said metal sheet is L-shaped and comprises a wider portion and a narrower portion.

6. The multi-band antenna as claimed in claim 5, wherein said insulative member is substantially cuboid shaped to adapt to the L-shaped metal sheet, and has a protruding rib engaging with the narrower portion to make sure the distal end of the protruding rib and the distal end of the metal sheet are coplanar.

7. The multi-band antenna as claimed in claim 1, wherein said grounding portion comprises a bending portion connecting with the first antenna and the second antenna and a first grounding portion extending perpendicularly from the bending portion.

8. The multi-band antenna as claimed in claim 7, wherein one side surface of said insulative member affixes to a surface of the metal sheet facing to the first grounding portion, and another side surface of the insulative affixes to a second antenna, and one surface of the insulative member facing to the first grounding portion is designated as a lower wall.

9. The multi-band antenna as claimed in claim 8, wherein said metal foil is inverted-U-shaped and comprises a top wall, a bottom wall and a side wall connecting with the top wall and the bottom wall, the top wall of the metal sheet is narrower than the wall of the insulative member affixed by the top wall in order to avoid electrically contacting with the second antenna.

10. The multi-band antenna as claimed in claim 9, wherein the bottom wall of the metal foil affixes to the lower wall of the insulative member, the top wall of the insulative member affixes to the metal sheet for establishing an electrical connection.

11. The multi-band antenna as claimed in claim 1, wherein the second antenna comprises a second radiating member, a second connecting portion and said grounding portion.

12. The multi-band antenna as claimed in claim 11, wherein the second radiating member comprises a third radiating portion, a fourth radiating portion connecting with the third radiating portion and a fifth radiating portion perpendicular to the third and fourth radiating portion.

13. A multi-band antenna, comprising:

an antenna body stamped from a metal sheet and comprising a radiating portion working at at least two spaced frequency bands, a grounding portion and a connecting portion connecting with the radiating portion and the grounding portion;

an insulative member affixed to the radiating portion of the antenna body; and a metal foil discrete from the metal sheet while being affixed to the insulative member and mechanically and electrically connecting with the radiating portion.

14. The multi-band antenna as claimed in claim 13, wherein said radiating portion comprises a first radiating portion, a second radiating portion electrically connecting with the first radiating potion, a third radiating portion, fourth radiating portion electrically connecting with the third radiating portion and a fifth radiating portion electrically connecting with the third radiating portion and the fourth radiating portion.

15. The multi-band antenna as claimed in claim 14, wherein said insulative member affixes to the first radiating portion.

16. The multi-band antenna as claimed in claim 14, wherein said metal foil is inverted-U shaped and affixes to the first radiating portion and the insulative member.

17. The multi-band antenna as claimed in claim 14, wherein said first radiating portion is capable of transmitting/receiving low-frequency.

18. The multi-band antenna as claimed in claim 14, wherein said metal foil is an AL foil.

19. The multi-band antenna as claimed in claim 13, wherein the metal foil is flexible and thinner than the metal sheet.

20. A multi-band antenna, comprising;

an antenna body stamped from a metal sheet and comprising a radiating portion, a grounding portion and a connecting portion connecting with the radiating portion and the grounding portion;

the radiating portion, the connecting portion and the grounding portion respectively defining three different planes commonly confining a space therein;

an insulative member located in said space therein with a metal foil wrapped therearoun; wherein said metal foil touches the radiating portion.

* * * * *